US007654897B2

(12) United States Patent
Devaull et al.

(10) Patent No.: US 7,654,897 B2
(45) **Date of Patent: *Feb. 2, 2010**

(54) BONUS ACCUMULATOR FOR A WAGERING GAME

(75) Inventors: John W. Devaull, Absecon, NJ (US); Alfred Thomas, Las Vegas, NV (US)

(73) Assignee: WMS Gaming Inc., Waukegan, IL (US)

( * ) Notice: Subject to any disclaimer, the term of this patent is extended or adjusted under 35 U.S.C. 154(b) by 851 days.

This patent is subject to a terminal disclaimer.

(21) Appl. No.: 10/705,699

(22) Filed: Nov. 10, 2003

(65) Prior Publication Data

US 2004/0110555 A1 Jun. 10, 2004

Related U.S. Application Data

(63) Continuation-in-part of application No. 09/833,105, filed on Apr. 11, 2001, now Pat. No. 6,739,971.

(51) Int. Cl.
*A63F 9/24* (2006.01)

(52) U.S. Cl. ..... 463/20; 463/25

(58) Field of Classification Search ..... None
See application file for complete search history.

(56) References Cited

U.S. PATENT DOCUMENTS

| | | | | |
|---|---|---|---|---|
| 5,377,973 | A | 1/1995 | Jones et al. | 463/12 |
| 5,788,573 | A * | 8/1998 | Baerlocher et al. | 463/16 |
| 5,816,918 | A * | 10/1998 | Kelly et al. | 463/16 |
| 5,935,002 | A | 8/1999 | Falciglia | 463/19 |
| 6,004,207 | A | 12/1999 | Wilson, Jr. et al. | 463/20 |
| 6,068,552 | A * | 5/2000 | Walker et al. | 463/21 |
| 6,120,031 | A | 9/2000 | Adams | 273/292 |
| 6,190,255 | B1 | 2/2001 | Thomas et al. | 463/20 |
| 6,319,125 | B1 * | 11/2001 | Acres | 463/25 |
| 6,609,975 | B1 | 8/2003 | Sawyer et al. | 463/26 |
| 6,620,045 | B2 * | 9/2003 | Berman et al. | 463/25 |
| 6,726,563 | B1 | 4/2004 | Baerlocher et al. | 463/25 |
| 6,739,971 | B2 * | 5/2004 | Devaull | 463/20 |
| 7,070,501 | B2 | 7/2006 | Cormack et al. | 463/16 |
| 2003/0157978 | A1 * | 8/2003 | Englman | 463/16 |

FOREIGN PATENT DOCUMENTS

| | | |
|---|---|---|
| EP | 0 281 402 A2 | 9/1988 |
| GB | 2 222 712 A | 3/1990 |

OTHER PUBLICATIONS

Product Sheet for Monopoly® Chairman of the Board™ (Reel), WMS Gaming Inc., 2 pages 1999.

(Continued)

*Primary Examiner*—M. Sager
(74) *Attorney, Agent, or Firm*—Nixon Peabody LLP

(57) ABSTRACT

A gaming machine for conducting a wagering game comprises a processor and a value input device for receiving a wager from a player to play the game. The processor is operative to accumulate bonus points based on predetermined criteria, and allow the player to redeem a number of the bonus points for an award at a time selected by the player.

10 Claims, 11 Drawing Sheets

OTHER PUBLICATIONS

Product Sheet for Monopoly® Chairman of the Board™ (Video), WMS Gaming Inc., (no date).
Product Sheet for Boom® Video, WMS Gaming Inc., 1 page (1998).
Product Sheet for XFACTOR™ Plus, WMS Gaming Inc., 2 pages (1997).
Brochure for Multi-Pay™, WMS Gaming Inc., 4 pages (1997).
Reproduction of Game Glass for Shopping Spree, WMS Gaming Inc., 1 page (no date).
Reproduction of Game Glass for Shopping Spree, WMS Gaming Inc., 1 page (available before 2000).
Product Sheet for Monopoly® Chairman of the Board™ (Video), WMS Gaming Inc., 1 page (published before 1999).

* cited by examiner

BONUS ACCUMULATOR FOR A WAGERING GAME

REFERENCE TO RELATED APPLICATIONS

This application is a continuation-in-part of U.S. application Ser. No. 09/833,105 entitled "Bonus Accumulator For Chance Game," filed Apr. 11, 2001, now U.S. Pat. No. 6,739,971 and incorporated herein by reference in its entirety.

FIELD OF THE INVENTION

The present invention relates generally to games of chance and, more particularly, to a game of chance including an "on-demand" bonus accumulator that accumulates bonus points based on predetermined criteria and allows the accumulated bonus points to be redeemed for play credits or game features during any game play cycle.

BACKGROUND OF THE INVENTION

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning each machine is roughly the same (or believed to be the same), players are most likely to be attracted to the most entertaining and exciting of the machines. Shrewd operators consequently strive to employ the most entertaining and exciting machines available because such machines attract frequent play and hence increase profitability to the operator. Accordingly, in the competitive gaming machine industry, there is a continuing need for gaming machine manufacturers to produce new types of games, or enhancements to existing games, which will attract frequent play by enhancing the entertainment value and excitement associated with the game.

A feature employed in some prior games is a bonus accumulator that accumulates points based on predetermined criteria. For example, a prior game entitled "Piggy Bankin'" includes three symbol-bearing reels and a bonus accumulator in the form of a piggy bank. In response to a wager, the reels are spun and stopped to place symbols on the reels in visual association with a pay line. For each spin resulting in three blanks along the pay line, the piggy bank is incremented by the wager amount. For a spin resulting in a "Break the Bank" symbol on the third reel, the player is awarded the accumulated total in the piggy bank. In another example, a prior game entitled "Boom" includes a plurality of symbol-bearing reels and a bonus accumulator in the form of a firecracker register. In response to a wager, the reels are spun and stopped to place symbols on the reels in visual association with multiple pay lines. A firecracker mark is added to the firecracker register for every 25 credits wagered. Each firecracker mark is worth one credit. The player is awarded a firecracker bonus equal to the number of firecracker marks in the firecracker register when either (1) the firecracker register reaches fifty firecracker marks, or (2) a spin results in two "wild match" symbols anywhere on the display.

Although such prior games are generally entertaining, the bonus accumulator suffers from a couple shortcomings. First, to redeem any bonus points accumulated in the bonus accumulator, a player must continue to wager and play the game until accomplishing an infrequent predetermined event that triggers the redemption of bonus points. If the player must walk away from the gaming machine for some reason, e.g., the player runs out of money, the player may be frustrated by his/her forfeiture of the bonus points which now remain in the bonus accumulator for redemption by a subsequent player. Second, because players may walk away before redeeming the accumulated bonus points, people looking to play a game with a bonus accumulator may scout for and hover around those machines with greater bonus points in the bonus accumulator.

A need therefore exists for a bonus accumulator that overcomes the above-noted shortcomings of the bonus accumulator employed in prior games.

SUMMARY OF THE INVENTION

A gaming machine for conducting a wagering game comprises a processor and a value input device for receiving a wager from a player to play the game. The processor is operative to accumulate bonus points based on predetermined criteria, and allow the player to redeem a number of the bonus points for an award at a time selected by the player.

BRIEF DESCRIPTION OF THE DRAWINGS

The foregoing and other advantages of the invention will become apparent upon reading the following detailed description and upon reference to the drawings.

Figure 1:
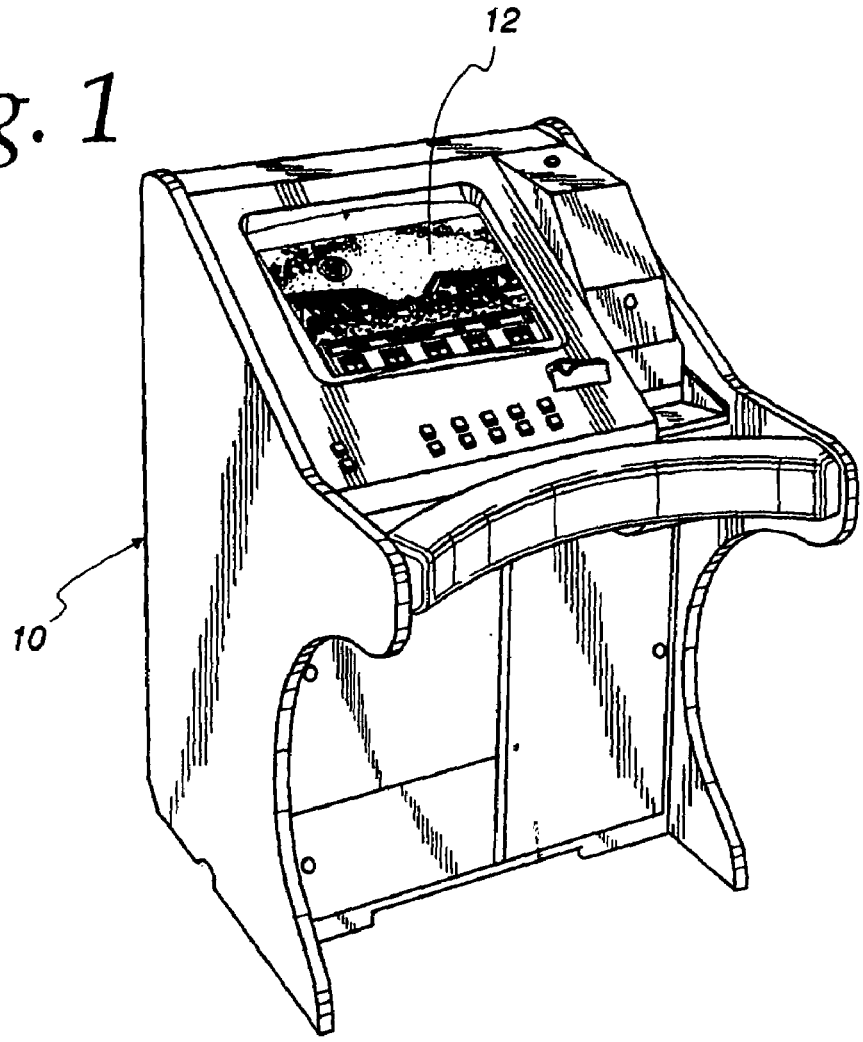
FIG. 1 is a perspective view of a gaming machine embodying the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DESCRIPTION OF ILLUSTRATIVE EMBODIMENTS

Turning now to the drawings and referring initially to FIG. 1, there is depicted a gaming machine 10 executing a game of chance that may be used to implement an "on-demand" bonus accumulator according to the present invention. The gaming machine 10 includes a visual display 12 preferably in the form of a dot matrix, CRT, LED, LCD, electro-luminescent, or other type of video display known in the art. The display 12 preferably includes a touch screen overlaying the monitor. In the illustrated embodiment, the gaming machine 10 is a "slant-top" version in which the display 12 is slanted at about a thirty-degree angle toward the player of the gaming machine 10. Alternatively, the gaming machine may be an "upright" version in which the display 12 is oriented vertically relative to the player.

In one embodiment, the gaming machine 10 is operable to play a game of chance entitled BOOM having a fireworks theme. The BOOM game is similar to the 1998 game of the same title by the instant assignee, except that it has been enhanced to include the "on-demand" bonus accumulator of the present invention. The enhanced BOOM game features a basic slot game with five simulated spinning reels and a bonus game triggered by a start-bonus outcome in the basic game. It will be appreciated, however, that the gaming machine 10 may be implemented with themes other than fireworks.

Figure 2:
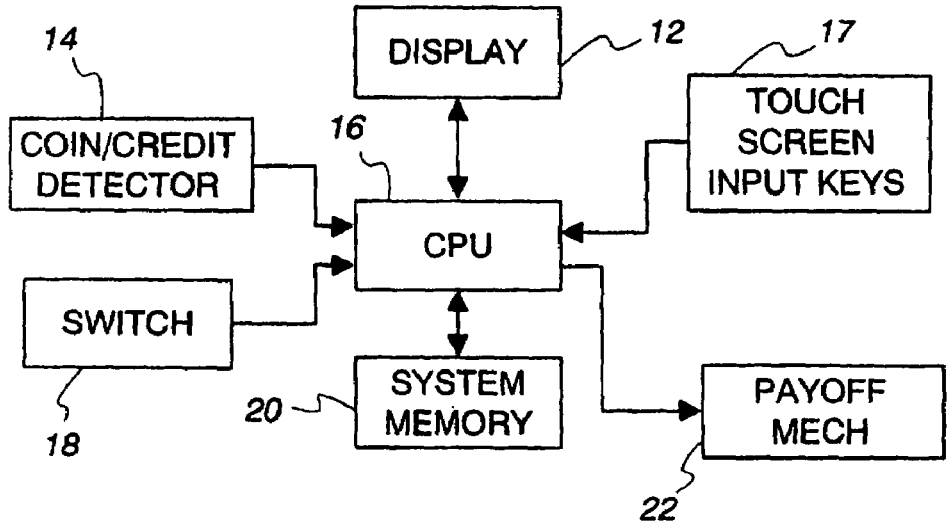
FIG. 2 is a block diagram of a control system suitable for operating the gaming machine.

FIG. 2 is a block diagram of a control system suitable for operating the gaming machine 10. Coin/credit detector 14 signals a central processing unit ("CPU") 16 when a player has inserted a number of coins or played a number of credits. Then, the CPU 16 operates to execute a game program that causes the display 12 to display the basic game that includes simulated symbol-bearing reels. The player may select the number of pay lines to play and the amount to wager via touch screen input keys 17. The basic game commences in response to the player activating a switch 18 (e.g., by pulling a lever or pushing a button), causing the CPU 16 to set the reels in motion, randomly select a game outcome, and then stop the reels to display symbols corresponding to the pre-selected game outcome. In one embodiment, one of the basic game outcomes causes the CPU 16 to enter a bonus mode whereby the display 12 shows a bonus game with animation of fireworks.

A system memory 20 stores control software, operational instructions and data associated with the gaming machine 10. In one embodiment, the memory 20 comprises a separate read-only memory (ROM) and battery-backed random-access memory (RAM). However, it will be appreciated that the system memory 20 may be implemented on any of several alternative types of memory structures or may be implemented on a single memory structure. A payoff mechanism 22 is operable in response to instructions from the CPU 16 to award a payoff of coins or credits to the player in response to certain winning outcomes which might occur in the basic or bonus games. The payoff amounts corresponding to certain combinations of symbols in the basic game is predetermined according to a pay table stored in system memory 20. The payoff amounts corresponding to certain outcomes of the bonus game are also stored in system memory 20.

Figure 3:
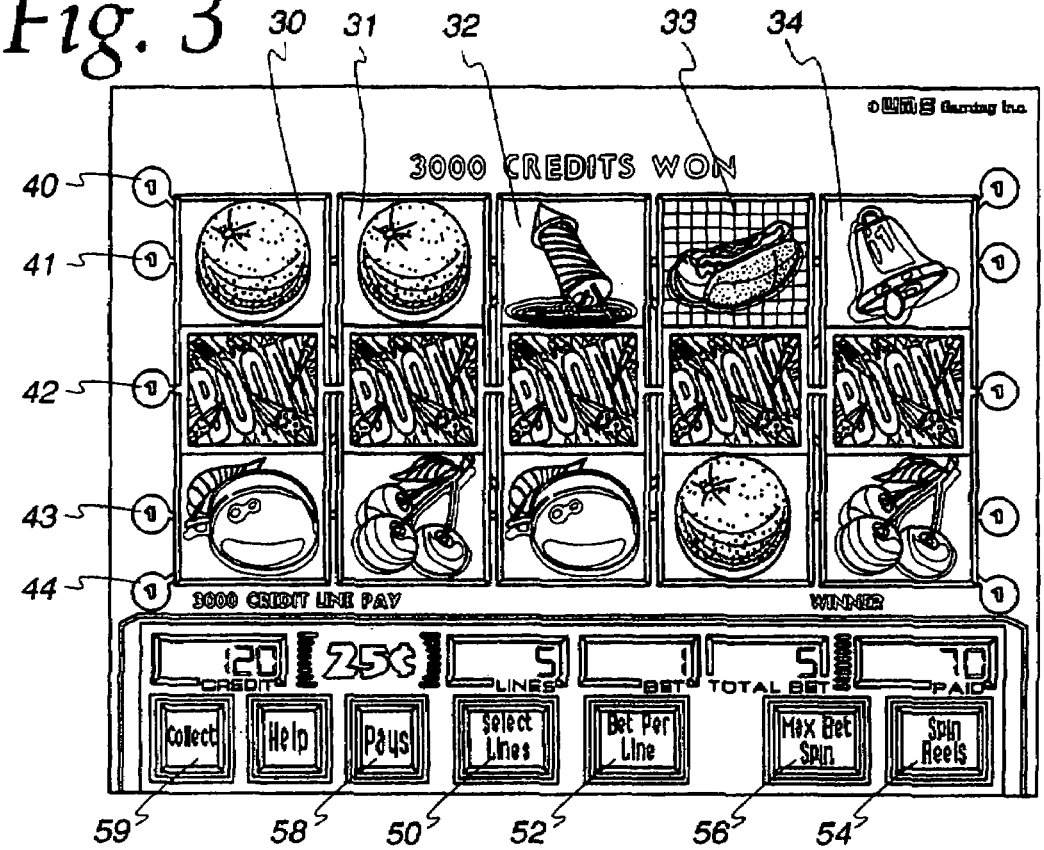
FIG. 3 is a display screen capture of a basic slot game executed on the gaming machine and showing a start-bonus combination for triggering a bonus game.

As shown in FIG. 3, the BOOM basic game is implemented on the display 12 on five video simulated spinning reels 30-34 with five pay lines 40-44. Each of the pay lines 40-44 extends through one symbol on each of the five reels 30-34. Generally, game play is initiated by inserting a number of coins or playing a number of credits, causing the CPU 16 (FIG. 2) to activate a number of pay lines corresponding to the number of coins or credits played. In one embodiment, the player selects the number of pay lines (between one and five) to play by pressing a "Select Lines" key 50 on the video display 12. The player then chooses the number of coins or credits to bet on the selected pay lines by pressing the "Bet Per Line" key 52.

After activation of the pay lines, the reels 30-34 may be set in motion by touching the "Spin Reels" key 54 or, if the player wishes to bet the maximum amount per line, by using the "Max Bet Spin" key 56 on the video display 12. Alternatively, other mechanisms such as, for example, a lever or push button may be used to set the reels in motion. The CPU 16 uses a random number generator to select a game outcome (e.g., "basic" game outcome) corresponding to a particular set of reel "stop positions." The CPU 16 then causes each of the video reels 30-34 to stop at the appropriate stop position. Video symbols are displayed on the reels 30-34 to graphically illustrate the reel stop positions and indicate whether the stop positions of the reels represent a winning game outcome.

Winning basic game outcomes (e.g., symbol combinations resulting in payment of coins or credits) are identifiable to the player by a pay table. In one embodiment, the pay table is affixed to the machine 10 and/or displayed by the video display 12 in response to a command by the player (e.g., by pressing the "Pay Table" button 58). A winning basic game outcome occurs when the symbols appearing on the reels 30-34 along an active pay line correspond to one of the winning combinations on the pay table. A winning combination, for example, could be three or more ORANGE symbols along an active pay line, where the award is greater as the number of ORANGE symbols along the active pay line increases. If the displayed symbols stop in a winning combination, the game credits the player an amount corresponding to the award in the pay table for that combination multiplied by the amount of credits bet on the winning pay line. The player may collect the amount of accumulated credits by pressing the "Collect" button 59. In one implementation, the winning combinations start from the first reel 30 (left to right) and span adjacent reels. In an alternative implementation, the winning combinations start from either the first reel 30 (left to right) or the fifth reel 34 (right to left) and span adjacent reels.

Included among the plurality of basic game outcomes is a start-bonus outcome for triggering play of a bonus game. A start-bonus outcome may be defined in any number of ways. For example, a start-bonus outcome occurs when a special start-bonus symbol or a special combination of symbols appears on one or more of the reels 30-34. The start-bonus outcome may require the combination of symbols to appear along an active pay line, or may alternatively require that the combination of symbols appear anywhere on the display regardless of whether the symbols are along an active pay line. The appearance of a start-bonus outcome causes the CPU to shift operation from the basic game to the bonus game.

Figure 4:
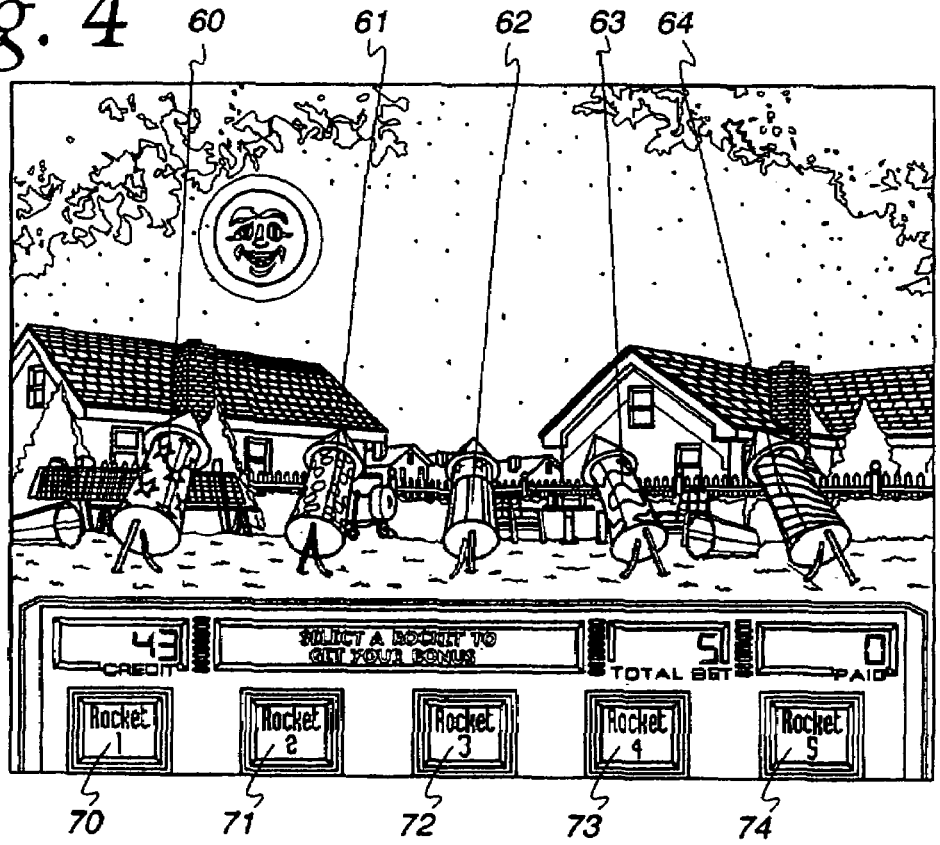
FIG. 4 is a display screen capture of the bonus game.

Three or more BOOM symbols along an active pay line trigger a bonus game with animation of fireworks. In FIG. 3, five BOOM symbols are depicted along the middle horizontal pay line 42. Referring to FIG. 4, in response to triggering the bonus game the display 12 depicts five rockets 60-64 and prompts the player to select one of the rockets via the corresponding touch keys 70-74 to get a bonus. The bonus is accompanied by an animation of fireworks in which the selected rocket is launched and exploded.

Figure 5:
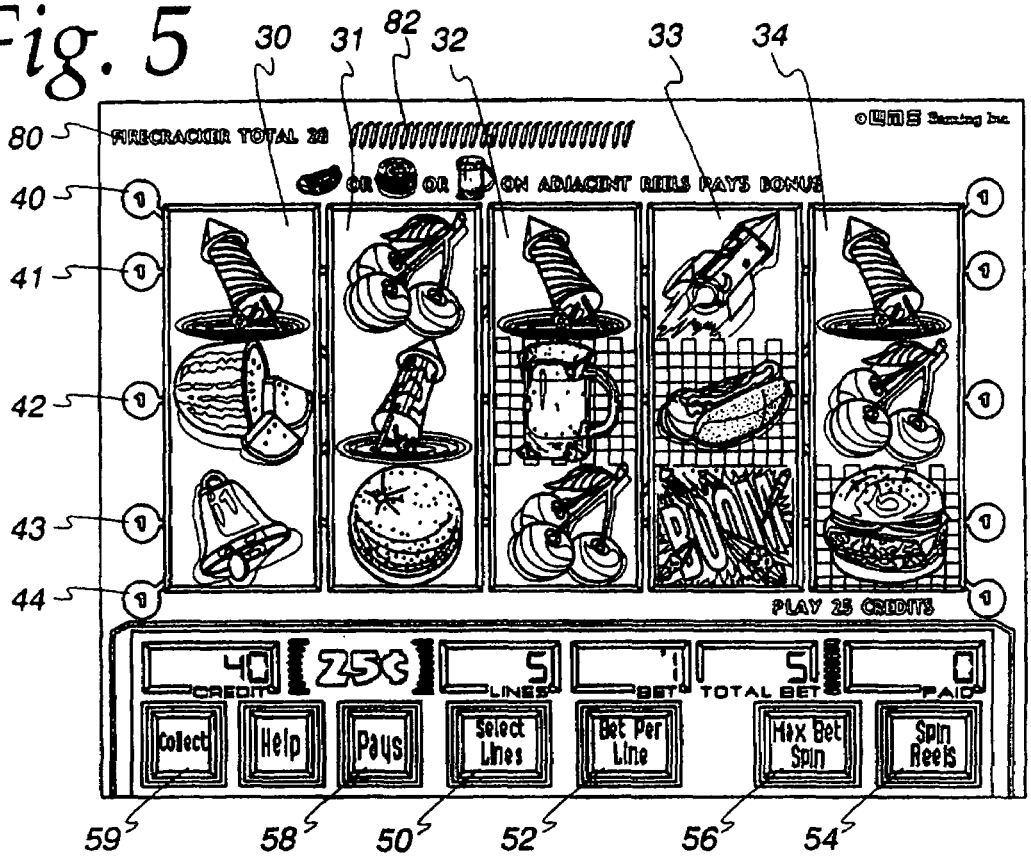
FIG. 5 is a display screen capture of the basic slot game showing a bonus accumulator in the form of a firecracker register.

Referring to FIG. 5, in accordance with the present invention, the enhanced BOOM game includes an "on-demand" bonus accumulator in the form of a firecracker register 80. In a first embodiment, a bonus point in the form of a firecracker mark 82 is added to the firecracker register 80 for every 25 credits wagered. In a second embodiment, a firecracker mark 82 is added to the firecracker register 80 for every winning spin resulting in a payout. In a third embodiment, a firecracker mark 82 is added to the firecracker register 80 for every winning spin resulting in a payout and a CANDY CANE ROCKET symbol on a winning pay line. In a fourth embodiment, a firecracker mark 82 is added to the firecracker register 80 for every spin that triggers the fireworks bonus game. In a fifth embodiment, a firecracker mark 82 is added to the firecracker register 80 for every losing spin resulting in no payout. The above embodiments can be combined such that a firecracker mark 82 is added to the firecracker register 80 in response to the occurrence of any of multiple events.

As discussed above, in the original BOOM game, the player was awarded a firecracker bonus equal to the number of firecracker marks in the firecracker register when either (1) the firecracker register reached fifty firecracker marks, or (2) a spin resulted in two "wild match" symbols anywhere on the display. The above prerequisites for redeeming the firecracker marks for a bonus could lead to frustration of players forced to walk away from the gaming machine before redemption and a "vulture" effect whereby new players hovered around those machines with larger numbers of firecracker marks in the firecracker register.

The enhanced BOOM game overcomes these problems by allowing a player to redeem the firecracker marks 82 in the firecracker register 80 for an award during any game play cycle. A game play cycle may be defined as starting with one wager triggering one spin of the reels and ending with a succeeding wager triggering another spin of the reels. In one embodiment, the player must redeem all the firecracker marks 82 in the firecracker register 80 at one time. In an alternative embodiment, the player may redeem a selected number of the firecracker marks 82 at one time. The award for which the firecracker marks 82 are redeemed may be in the form of credits or a game feature.

Figure 6:
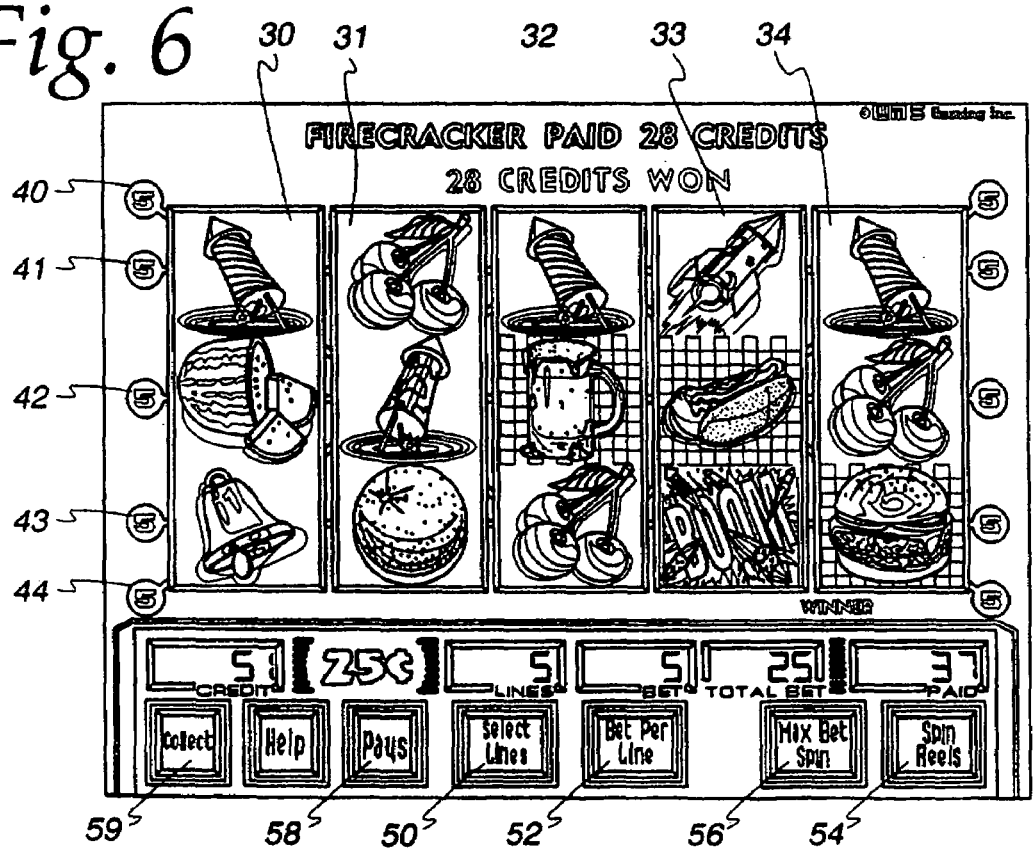
FIG. 6 is a display screen capture of the basic slot game showing firecracker marks in the firecracker register having been redeemed for credits.

In a first embodiment, the award is in the form of credits. Each firecracker mark 82 is worth a predetermined number of credits such as one credit. In FIG. 6, for example, the 28 firecracker marks 82 that were in the firecracker register 80 in FIG. 5 have been redeemed for 28 credits.

In a second embodiment, the award is in the form of free spins of the reels 30-34. The number of free spins corresponds to the number of firecracker marks 82 being redeemed. Instead of a slot game, the game of chance executed on the gaming machine may be poker, blackjack, roulette, keno, bingo, or the like. In this case, the award is in the form of free plays of the game.

In a third embodiment, if the game is poker, the award may be in the form of one or more wild cards in the poker game. The number of wild cards corresponds to the number of bonus points (e.g., firecracker marks 82) being redeemed. The game may be designed to allow such redemption before any playing cards are revealed to the player, after the cards are revealed but prior to the draw in draw poker, or after the draw.

In a fourth embodiment, the award is in the form of free plays of the bonus game depicted in FIG. 4. The number of free plays of the bonus game corresponds to the number of firecracker marks 82 being redeemed. Of course, in order for the game to maintain a payback percentage under 100 percent and remain profitable to the operator, the probability of earning a bonus point (e.g., firecracker mark 82) and/or the average number of credits awarded by the bonus game may need to be reduced.

In a fifth embodiment, the award is in the form of credits or a game feature depending upon the number of firecracker marks 82 in the firecracker register 80. For example, to trigger the game feature, the game may require the player to redeem fifty firecracker marks 82. That is, the threshold for redeeming the firecracker marks 82 for the game feature is fifty firecracker marks. If, however, the player wishes to redeem the firecracker marks 82 prior to accumulating fifty such marks 82 in the firecracker register 80, the game may instead provide an award in the form of credits. The number of awarded credits may be prorated based on the average number of credits awarded by the game feature and the number of redeemed firecracker marks 82. For example, if the average number of credits awarded by the game feature is 300 credits but the player wishes to redeem 25 firecracker marks 82 instead of waiting for fifty such marks 82 to accumulate in the firecracker register 80, the game may award 150 credits (=300×25/50) for the player's redemption of 25 firecracker marks 82.

In a sixth embodiment, the award is graduated such that the greater the number of firecracker marks 82 in the firecracker register 80, the greater the redemption value of each mark. For example, if the award is in the form of credits, 10-19 firecracker marks may be redeemed at a ratio of one credit per mark; 20-29 firecracker marks may be redeemed at a ratio of two credits per mark; 30-39 firecracker marks may be redeemed at a ratio of three credits per mark; and so on. The graduated award scale acts as an incentive for players to stay at the gaming machine and earn sufficient firecracker marks 82 to reach higher levels in the graduated award scale. At the same time, however, the player is not severely penalized for early redemption.

Figure 7:
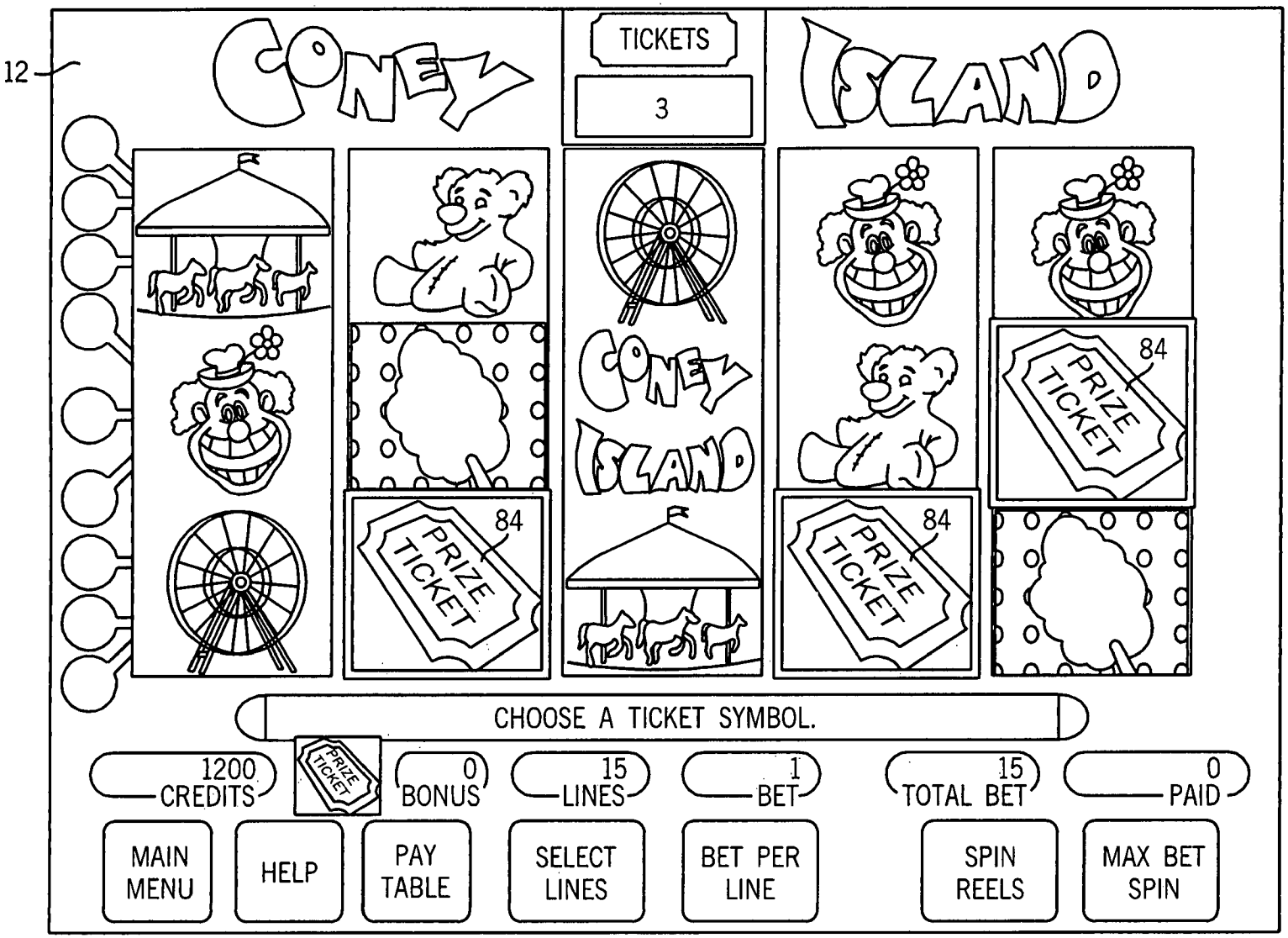
FIG. 7 is a display screen capture of another example of a basic slot game executed on the gaming machine and showing another example of a start-bonus combination for triggering a bonus game.

Another example of the bonus accumulator is found in a five-reel video multi-line slot game titled "Coney Island" as depicted in FIG. 7. A feature of this game is the accumulation of bonus points in the form of "tickets," which are then redeemed to play bonus games on a bonus screen at the player's discretion.

Figure 8:
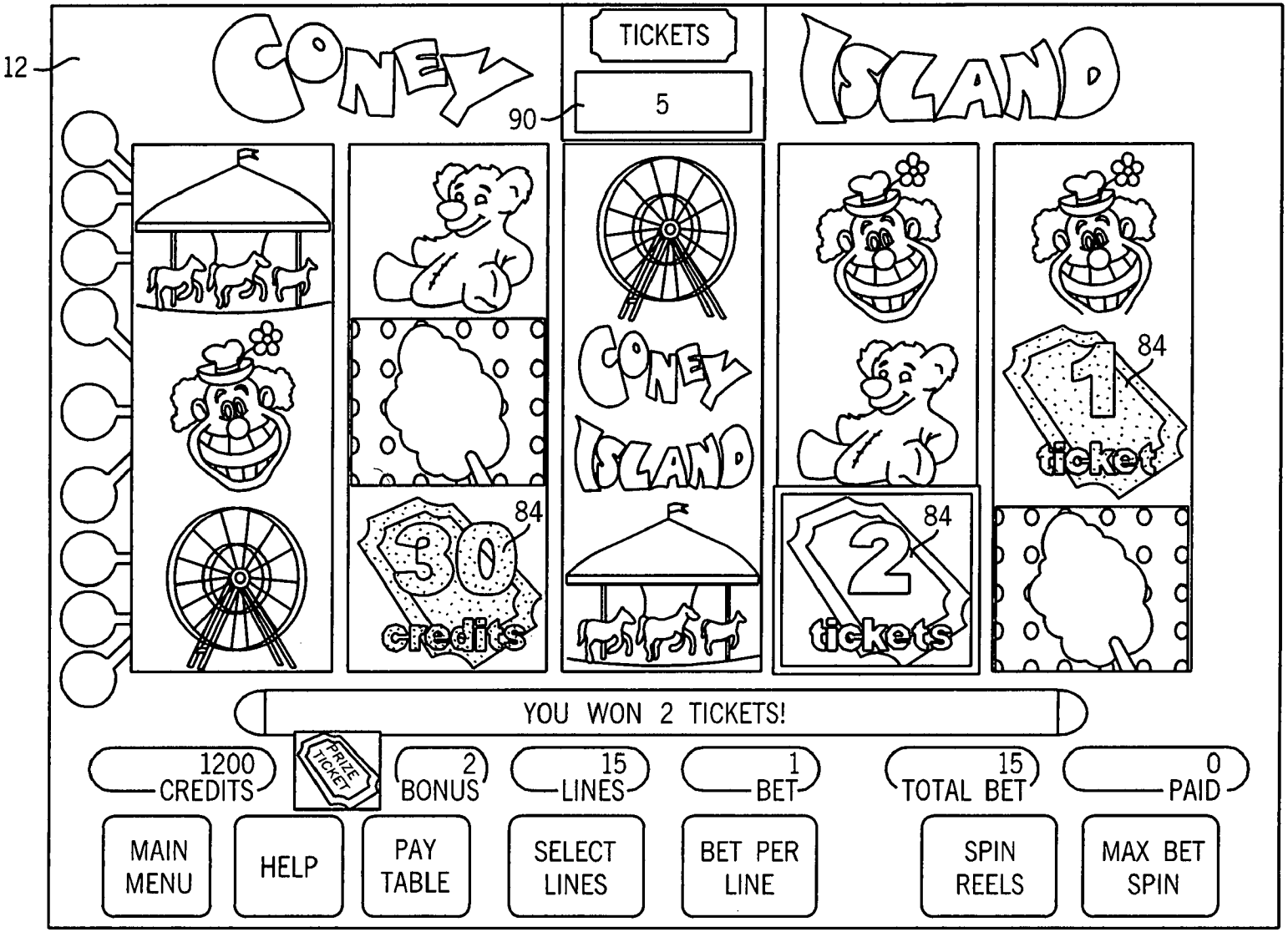
FIG. 8 is a display screen capture of the basic slot game in FIG. 7 after a player has chosen a ticket to reveal a bonus prize.

Referring to FIG. 7, the initial bonus is triggered on the display screen 12 when three prize tickets 84 appear on any of the five video reels. The player is prompted to choose a ticket (by touch) to reveal the bonus prize. FIG. 8 shows that in this example, the player chose the prize ticket 84 in the fourth reel revealing a prize of 2 tickets. These tickets are added to a ticket meter 90 which keeps a running total of tickets won. The prize tickets not selected by the player are revealed to show what could have been won. The ticket meter 90 in this embodiment shows that a total of five (5) tickets have been accumulated. The player in this example decides to enter the next phase of the bonus by touching the ticket meter 90.

Figure 9:
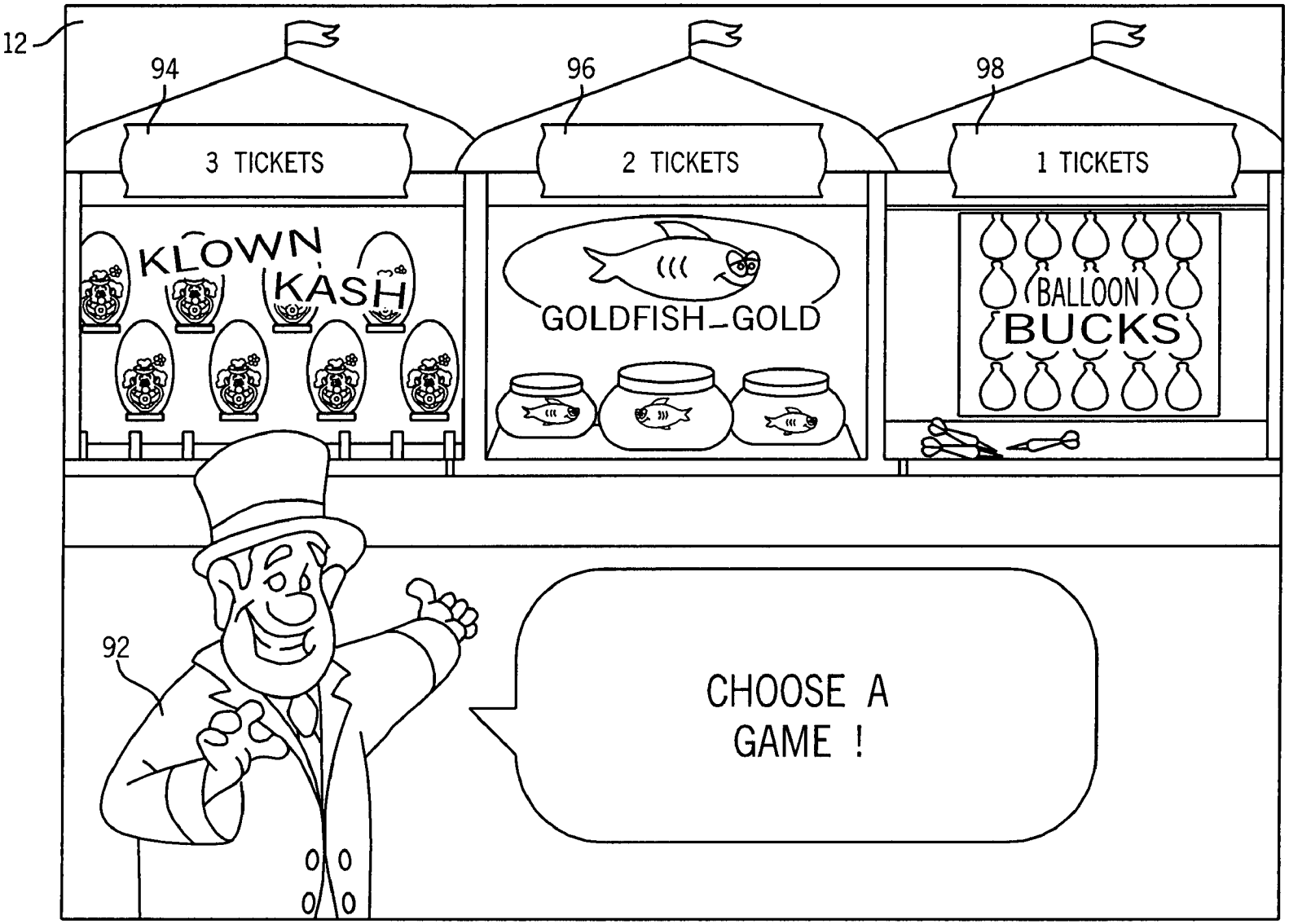
FIG. 9 is a display screen capture of the bonus round games that may be selected by a player in the example bonus game in FIG. 7.

FIG. 9 shows the bonus round games that can be selected by the player. The animated "ringmaster" 92 urges the player to choose a game. Three bonus games are available to the player and each costs a different number of tickets to play. The risk-reward for each bonus game is based on the number of tickets that game costs to play. In this example, the three games are "Klown Kash" (3 tickets) 94, "Goldfish Gold" (2 tickets) 96, and "Balloon Bucks" (1 ticket) 98. The amount of the bonus won is more likely to be higher in the Klown Kash 94 bonus game than the Goldfish Gold 96 or Balloon Bucks 98 bonus games because the amount wagered is higher (three tickets verses two or one). However, the prize tickets have an inherent value (for example, 100 credits as depicted in FIG.

14) and the player risks receiving a prize less valuable that the actual value of the ticket(s) should a bonus game be played instead of cashing in. In this example, the player chooses to play Klown Kash 94 for three (3) prize tickets.

Figure 10:
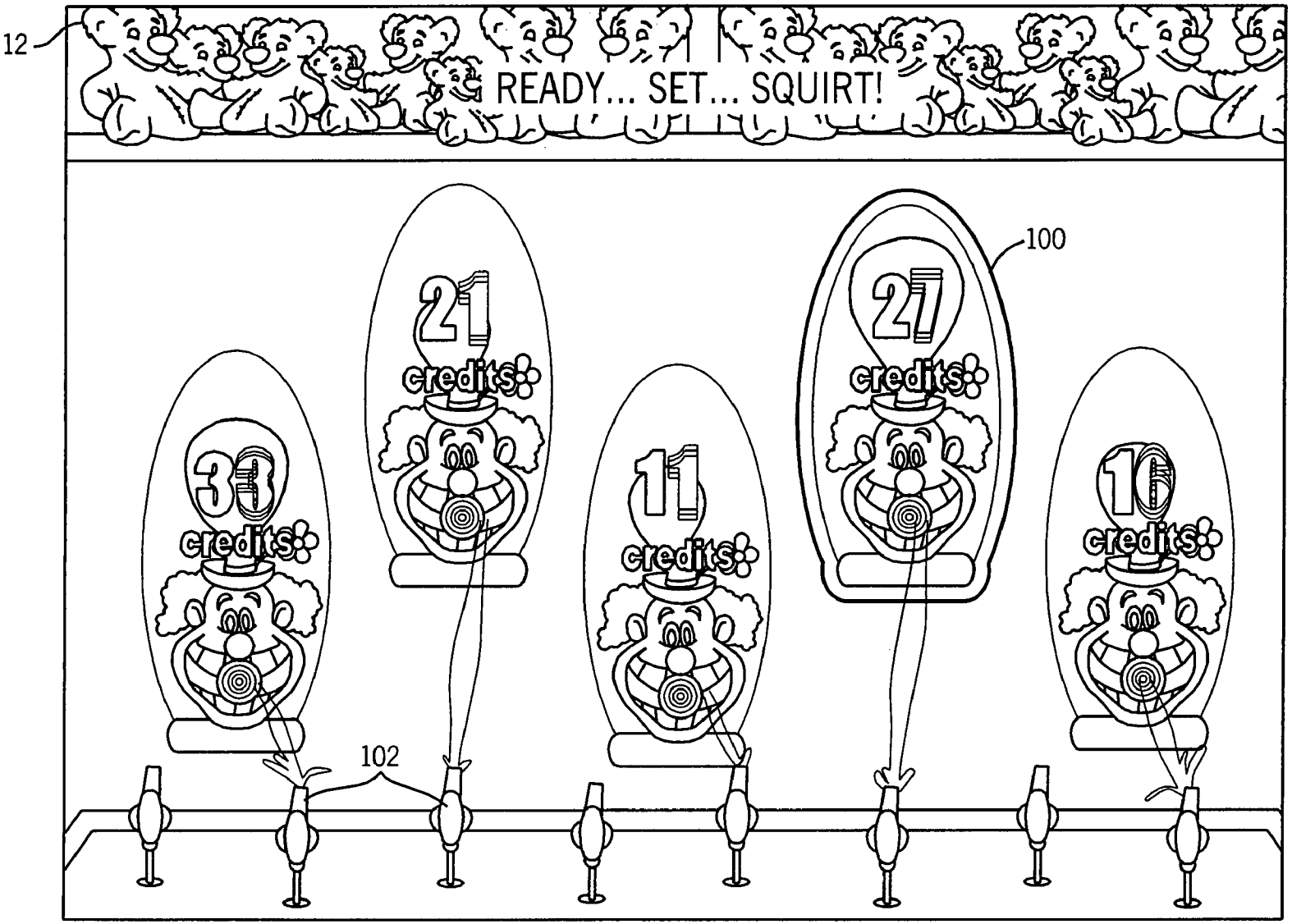
FIG. 10 is a display screen capture of one of the bonus games that may be selected from FIG. 9.
Figure 11:
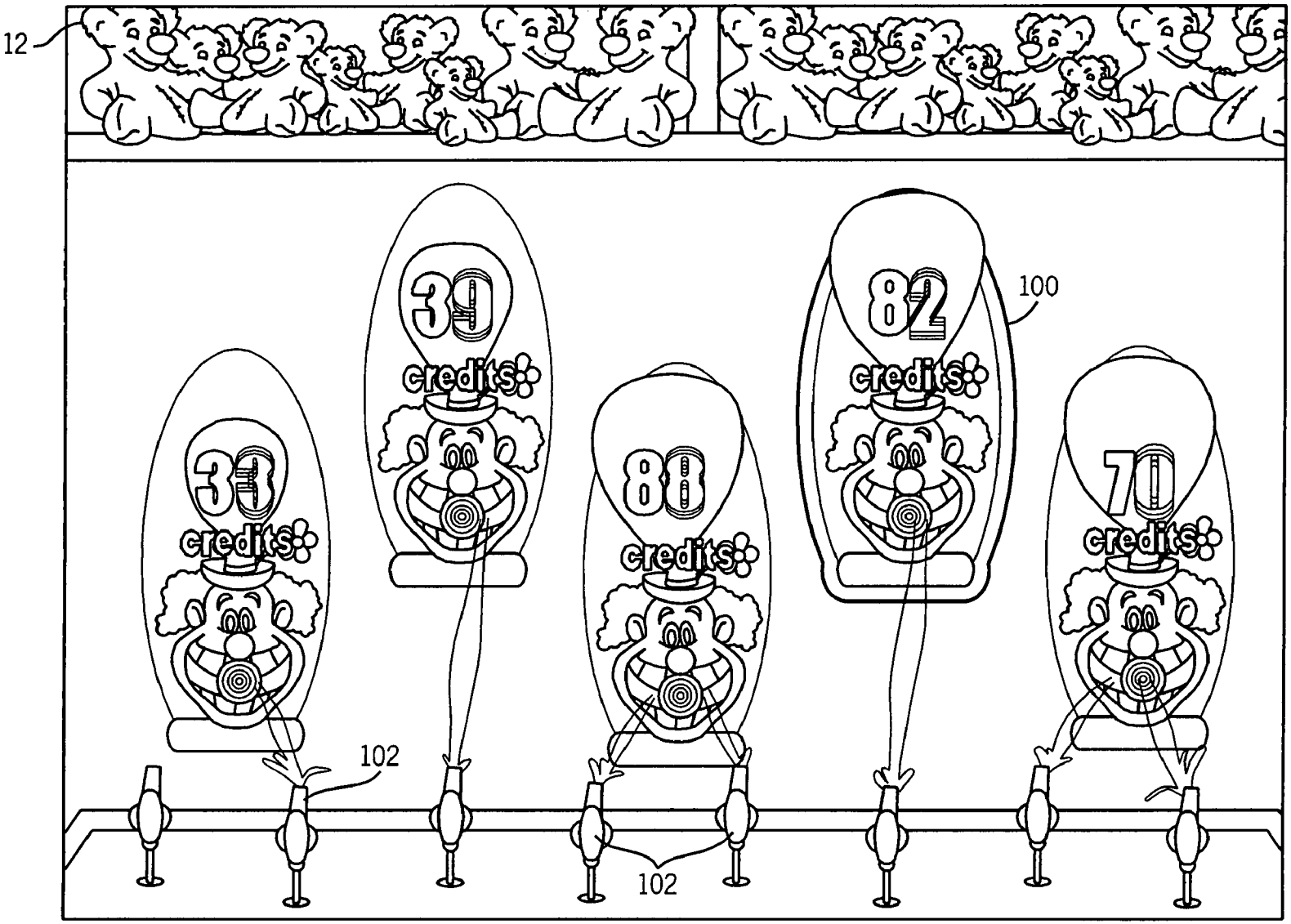
FIG. 11 is a display screen capture of the play of the selected bonus game shown in FIG. 10.

FIG. 10 shows the Klown Kash bonus as the game begins. The premise of this game is similar to balloon games found at many carnivals and amusement parks. The player squirts water from a squirt gun at a target causing a balloon to blow up. The first balloon to burst is the winner. In this example, the player has selected a clown 100. As the game begins, the balloon of player's chosen clown 100 begins to expand and accumulate credits (27 credits) caused by the "squirting" of water from the animated squirt guns. FIG. 11 shows the continuation of the Klown Kash game in which the balloons continue to expand and credits continue to accumulate. At this point in the bonus game, additional squirt guns 102 may start "squirting", rapidly increasing the credit accumulation for those clowns being hit by more than one squirt gun 102. Although the additional squirt guns start randomly, it will be appreciated by those with ordinary skill in the art that the player could have an effect on which additional squirt guns start by either a chance selection of a working secondary squirt gun or through an additional credit payment. The clown 100 chosen by the player in this example currently shows an accumulation of 82 credits.

Figure 12:
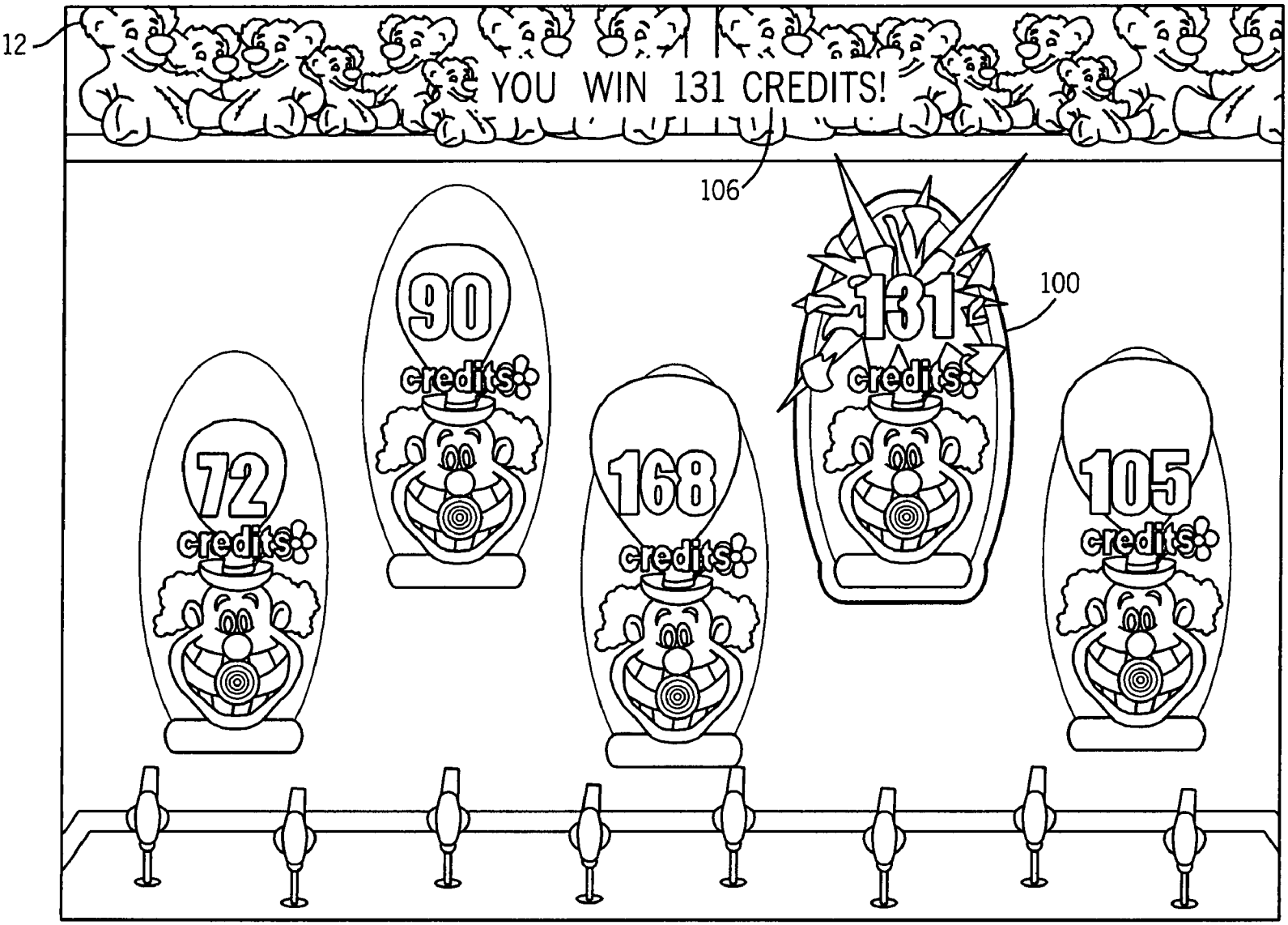
FIG. 12 is a display screen capture of a bonus accumulation screen resulting from the selected bonus game shown in FIG. 10.

FIG. 12 shows the balloon of the player's chosen clown 100 bursting. At this point, the game awards the player with the amount shown on the balloon (131 credits) at the time it burst. Since the balloon that burst was associated with the player's chosen clown 100, the player is also awarded the credits accumulated on the other balloons (a total of 566 credits). Should a balloon burst other than the player's chosen balloon, the player would only have been awarded the credits displayed on their balloon.

Figure 13:
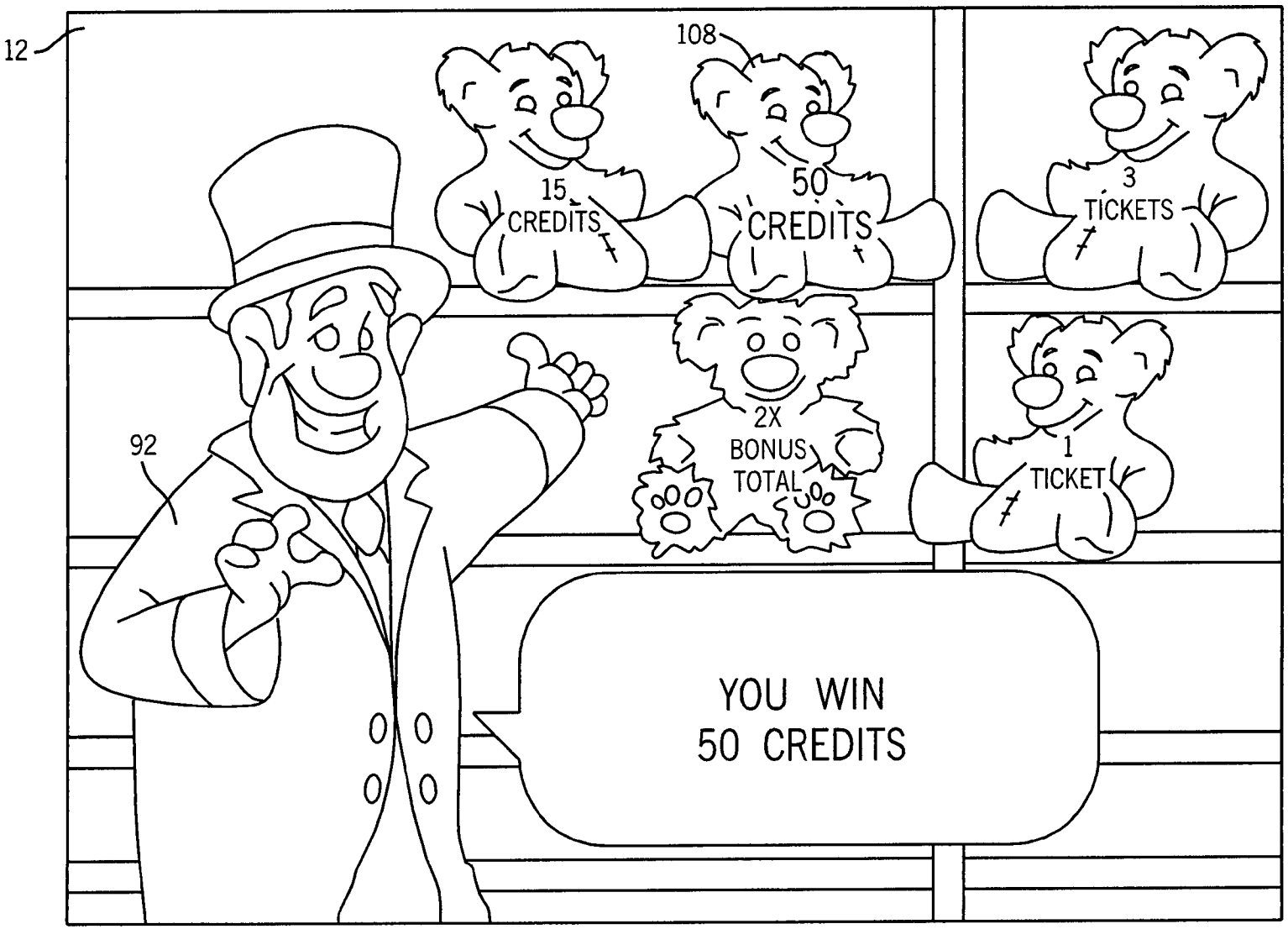
FIG. 13 is a display screen capture of the next phase of the bonus round of the selected bonus game shown in FIG. 10.

FIG. 13 shows the next phase of the bonus round. After being prompted to select a prize, the ringmaster 92 informs the player what the selection 108 is worth, in this instance, 50 credits. Other prizes that were not chosen are shown to display what could have been won. Note the prize tickets that could have been won and added to the ticket meter.

Figure 14:
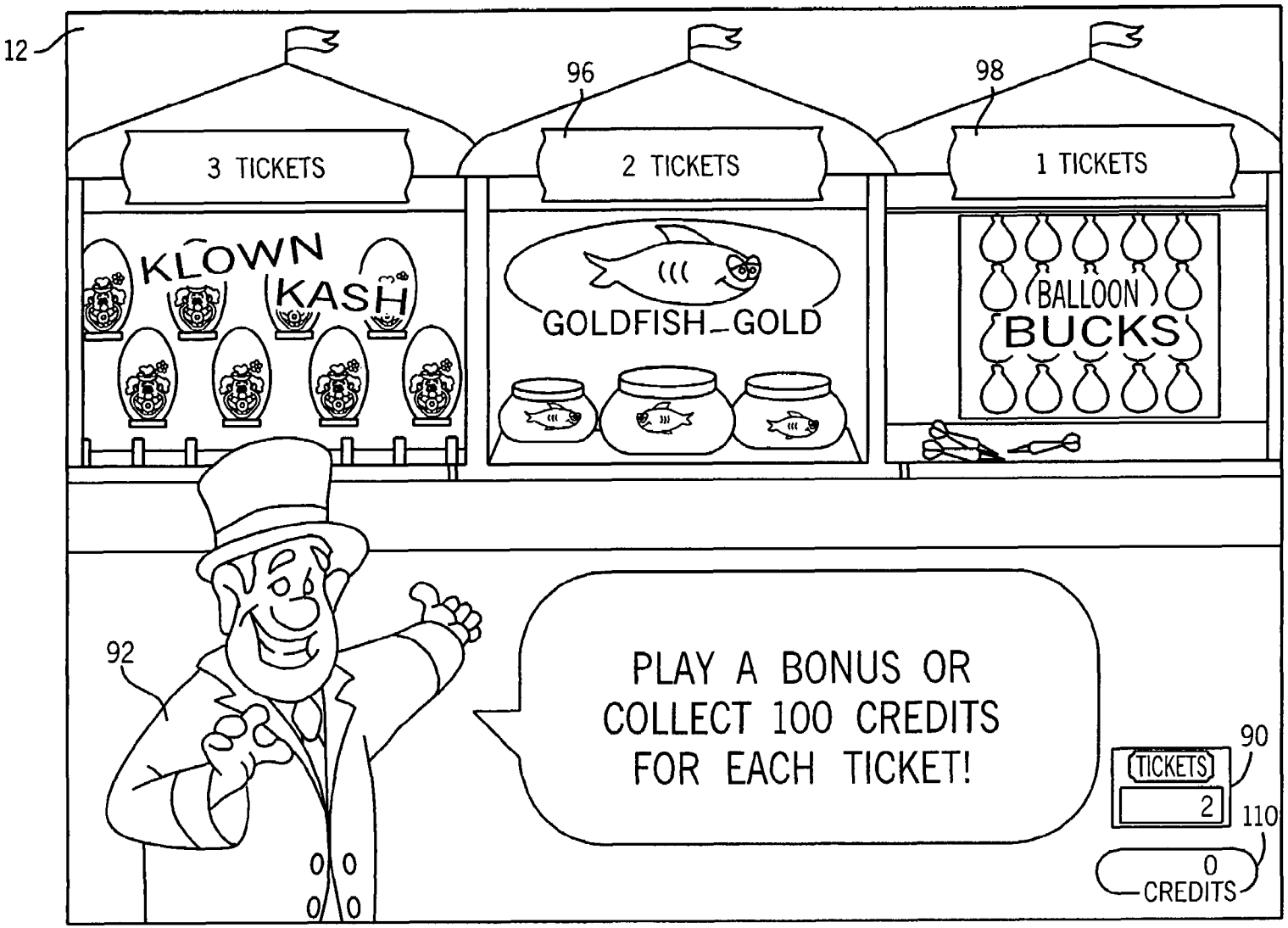
FIG. 14 is a display screen capture of the game returning to the starting point of the bonus round.

FIG. 14 shows the game returning to the starting point of the bonus round. In the lower right corner of the display 12, two counters are visible. The ticket meter 90 displays the remaining number of prize tickets the player has available. The other counter is a credit meter that identifies the current number of credits the player has accumulated. Another meter that can be displayed is a bonus meter that displays the current total number of credits won during the bonus round only. The animated ringmaster 92 now asks the player if they want to play another bonus game or cash in their prize tickets (shown on the ticket meter 90) for 100 credits each. Note that the ticket meter only shows two (2) tickets remaining. This only allows the player to play either the Goldfish Gold game 96 or the Balloon Bucks game 98 since those games cost two (2) and one (1) ticket(s) respectively. The player also has the option to keep the prize tickets and return to the basic reel slot game. In the example shown in FIG. 14, if the player with only two (2) prize tickets remaining wants to play Klown Kash again costing three (3) prize tickets, he/she must return to the basic slot game and accumulate at least one more prize ticket. In one option specified above, the player can cash in the accumulated prize tickets for a specified credit amount, in this instance, 100 credits each. In any of the bonus games available in the bonus round, the player will receive a bonus payout of a random value. However, this may be less than, equal to, or greater than the specified credit value of the prize tickets if cashed in by the player. For example, instead of cashing in two prize tickets for a total of 200 credits, the player decides to play Goldfish Gold 96. The player may realize a return from the bonus game of a random amount that may be less than or greater than 200 credits. The player has the choice and assumes the risk.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A method of conducting a wagering game, the wagering game including a game sequence in which a player makes a wager and a wagering game outcome is determined, the method comprising:

conducting the wagering game using a gaming apparatus to receive inputs from the player and to generate wagering game outcomes that are communicated to the player, the gaming apparatus including a user interface device configured to receive an input from the player a display device configured to display information or graphics to be viewed by the player, one or more storage devices, and one or more processors configured to execute computer instructions relating to the wagering game;

receiving a wager from a player to play the wagering game at the user interface device;

transforming the player input into electronic data signals indicative of a wager to play the wagering game;

using one of the processors to interpret the wager from the data signals and to, at least in part, cause the recording of a digital representation of the wager in a gaming apparatus storage device;

using one of the gaming apparatus processors to cause the display of a visual indication of the wager on the display device;

using a gaming apparatus processor to initiate a game sequence of the wagering game on the gaming apparatus, wherein the game sequence includes accumulating bonus points based on a randomly selected outcome in the wagering game; and offering the player a selection of a plurality of player-selectable options to redeem a number of the bonus points at a time selected by the player, the plurality of player-selectable options including: (i) an immediately specified wagering game credit amount and (ii) a bonus game feature for determining a random award greater than, equal to or less than the immediately specified wagering game credit amount.

2. The method of claim 1, wherein the plurality of possible options include a plurality of bonus game features worth different numbers of the bonus points such that the different numbers of the bonus points are redeemed to play the respective bonus game features.

3. The method of claim 2, wherein the bonus game features are interactive.

4. The method of claim 1, wherein the bonus game feature includes a plurality of player-selectable elements.

5. The method of claim 1, wherein the allowing includes allowing the player to redeem the number of the bonus points during any game play cycle defined as starting with the wager and ending with a succeeding wager triggering another play of the game.

6. A gaming machine for conducting a wagering game, comprising:

a value input device for receiving a wager from a player to play the wagering game; and a processor operative to accumulate bonus points based on a randomly selected outcome in the wagering game; and allow the player to redeem a number of the bonus points by selecting any one of a plurality of player-selectable options at a time selected by the player, the plurality of player-selectable options including: (i) an immediately specified wagering game credit amount awarded to the player as a result of the selection and (ii) a bonus game feature awarded to the player as a result of the selection for determining a random wagering game credit award greater than, equal to or less than the immediately specified wagering game credit amount.

7. The machine of claim 6, wherein the plurality of possible options include a plurality of bonus game features worth different numbers of the bonus points such that the different numbers of the bonus points are redeemed to play the respective bonus game features.

8. The machine of claim 7, wherein the bonus game features are interactive.

9. The machine of claim 6, wherein the bonus game feature includes a plurality of player-selectable elements.

10. The machine of claim 6, wherein the processor is operative to allow the player to redeem the number of the bonus points during any game play cycle defined as starting with the wager and ending with a succeeding wager triggering another play of the game.

* * * * *

UNITED STATES PATENT AND TRADEMARK OFFICE

CERTIFICATE OF CORRECTION

PATENT NO. : 7,654,897 B2
APPLICATION NO. : 10/705699
DATED : February 2, 2010
INVENTOR(S) : Devaull et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1352 days.

Signed and Sealed this

Twenty-third Day of November, 2010

David J. Kappos

David J. Kappos
*Director of the United States Patent and Trademark Office*